US006283798B1

(12) United States Patent
Takahashi

(10) Patent No.: US 6,283,798 B1
(45) Date of Patent: Sep. 4, 2001

(54) TERMINAL STRUCTURE

(75) Inventor: Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/286,254

(22) Filed: Apr. 6, 1999

(30) Foreign Application Priority Data

Apr. 7, 1998 (JP) ..... 10-094891

(51) Int. Cl.[7] ..... H01R 13/405

(52) U.S. Cl. ..... 439/736; 439/733.1; 439/884; 264/263

(58) Field of Search ..... 439/736, 733.1, 439/884, 885, 264; 264/253

(56) References Cited

U.S. PATENT DOCUMENTS 4,284,314 * 8/1981 Lesyk ..... 339/75
4,618,207 * 10/1986 Silbernagel ..... 339/176
4,734,043 * 3/1988 Emert et al. ..... 439/65
5,938,039 * 8/1999 Liu ..... 206/717

* cited by examiner

*Primary Examiner*—Paula Bradley
*Assistant Examiner*—Truc Nguyen
(74) *Attorney, Agent, or Firm*—Sughrue, Mion, Zinn, Macpeak & Seas, PLLC

(57) ABSTRACT

A terminal structure designed to prevent bus bars from being brought into contact with and rubbing against each other when the terminal structure is built of a plurality of bus bars which are fixed by resin-molding. Circuit members are formed with a plurality of bus bars respectively constituting internal circuits. The plurality of bus bars are coupled together by respective coupling portions in parallel with a space provided between the bus bars. The circuit members are successively set in a mold in such a way that the bus bars of the other circuit member are fitted in between the bus bars of one circuit member without contact with the bus bars of the one circuit member whereby the bus bars in that set condition are fixed by resin-molding. Moreover, a position regulating portion is provided by bending the coupling portion of the other circuit member, so that the other circuit member is temporarily set therein with a space formed from the bus bars of the one circuit member.

5 Claims, 3 Drawing Sheets

TERMINAL STRUCTURE

BACKGROUND OF THE INVENTION

1. Field of the Invention

This invention relates to a terminal structure provided on the inside of an electrical component part such as a connector.

2. Description of the Related Art

Bus bars in the form of a plurality of pins are used as the internal circuits of some electrical component parts such as connectors. Such a bus bar must be prevented from being brought into contact with an adjoining bus bar. Consequently, a required number of bus bars are inserted into a mold and the bus bars thus inserted are resin-molded to fix the bus bars.

FIG. 3 shows conventional circuit members 1 and 2 for use in insert molding. The circuit member 1 has a plurality of bus bars 3 and the circuit member 2 also has a plurality of bus bars 4. In this case, the circuit members 1 and 2 have coupling portions 5 and 6 respectively in order that adjoining bus bars 3 and 4 are coupled together with a space provided therebetween. The coupling portions 5 and 6 are provided on the respective one end sides of the bus bars 3 and 4, the other end sides of the bus bars 3 and 4 being used as free ends 3*a* and 4*a*. Furthermore, the bus bars 3 and 4 have connecting portions 9 and 10 respectively (see FIGS. 4(*a*) to 4(*c*)), the connecting portions 9 and 10 being connected by wire bonding to a printed circuit board or the like. The connecting portions 9 and 10 are respectively plated with conductive materials such as gold so as to carry out wire bonding.

In order to form an internal circuit of an electrical component by the use of the aforementioned circuit members 1 and 2, the procedure shown in FIGS. 4(*a*) to 4(*c*) is followed. As shown in FIG. 4(*a*), the free end 3*a* of the bus bar 3 of one circuit member 1 is inserted and set into a positioning hole (not shown) of a bottom force 7 first. Then the free end 4*a* of the bus bar 4 of the other circuit member 2 is inserted into the positioning hole of the bottom force 7. At this time, the other circuit member 2 is kept floating from the bottom force 7.

As shown by an arrow in FIG. 4(*b*), the bus bars 4 of the other circuit member 2 are fitted in between the bus bars 3 of the one circuit member 1 by sliding the other circuit member 2 downward so that the circuit members 1 and 2 are set in the same plane. Then a top force 8 is lowered as shown in FIG. 4(*c*) to effect clamping and resin is injected into the mold for hardening thereafter. Thus, the bus bars 3 and 4 are fixedly formed to provide a terminal structure. The coupling portions 5 and 6 of the circuit members 1 and 2 are removed by cutting after the resin-molding process is performed.

However, the bus bars 3 and 4 are caused to rub against each other in the process of forming the conventional terminal structure when the circuit members 1 and 2 are successively set in the bottom force 7 before the bus bars 4 of the circuit member 2 are fitted in between the bus bars 3 of the circuit member 1. The rubbing poses a problem in that the conductive materials used to cover the connecting portions 9 and 10 of the respective bus bars 3 and 4 come off or scratches are made on the surfaces of the bus bars, which results in faulty wire bonding.

SUMMARY OF THE INVENTION

An object of this invention is to provide a terminal structure without causing a conductive plating to come off and also causing any damage to the structure by preventing bus bars from rubbing against each other when circuit members are set up.

In order to accomplish the object above, the invention provides a terminal structure in which two circuit members are formed with a plurality of bus bars respectively constituting internal circuits, the plurality of bus bars being coupled together in parallel by respective coupling portions with a space provided between the bus bars and in which circuit members are successively set in a mold in such a way that the bus bars of the other of the circuit members are fitted in between the bus bars of one of the circuit members without contact with the bus bars of the one circuit member whereby the bus bars in that set condition are fixed by resin-molding, wherein a position regulating portion for temporarily setting the other circuit member in the mold is provided in the other circuit member, whereby to temporarily set the other circuit member with a space formed from the bus bars of the one circuit member.

The position regulating portion functions as what has the other circuit member spaced out from the bus bars of the one circuit member when the other circuit member is set in the mold. Therefore, the bus bars of the two circuit members are prevented from being brought into contact with and rubbing against each other at the initial stage of setting the circuit member in the mold.

In the temporarily set condition, the positions of the bus bars can be adjusted lest the bus bars of the circuit members should be brought into contact with each other. After the positions of the bus bars are adjusted, the bus bars of the other circuit member are fitted in between the bus bars of the one circuit member by releasing the temporarily set condition of the other circuit member to establish a complete set condition. Therefore, the bus bars of the circuit members are prevented from being brought into contact with and rubbing against each other when the other circuit member is set.

DETAILED DESCRIPTION OF THE PREFERRED EMBODIMENT

Figure 1:
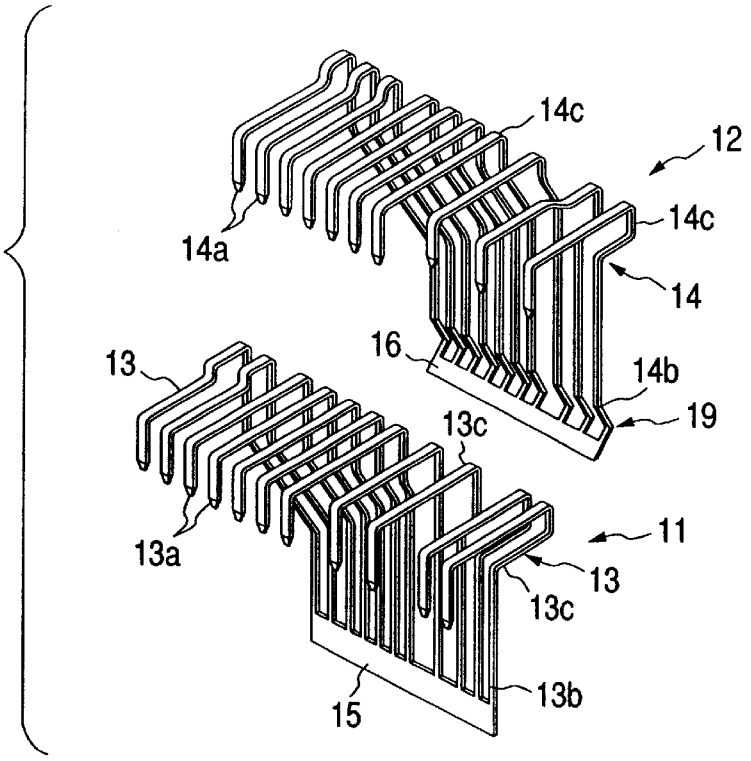
FIG. 1 is a perspective view of circuit members for use in an embodiment of this invention.
Figure 3:
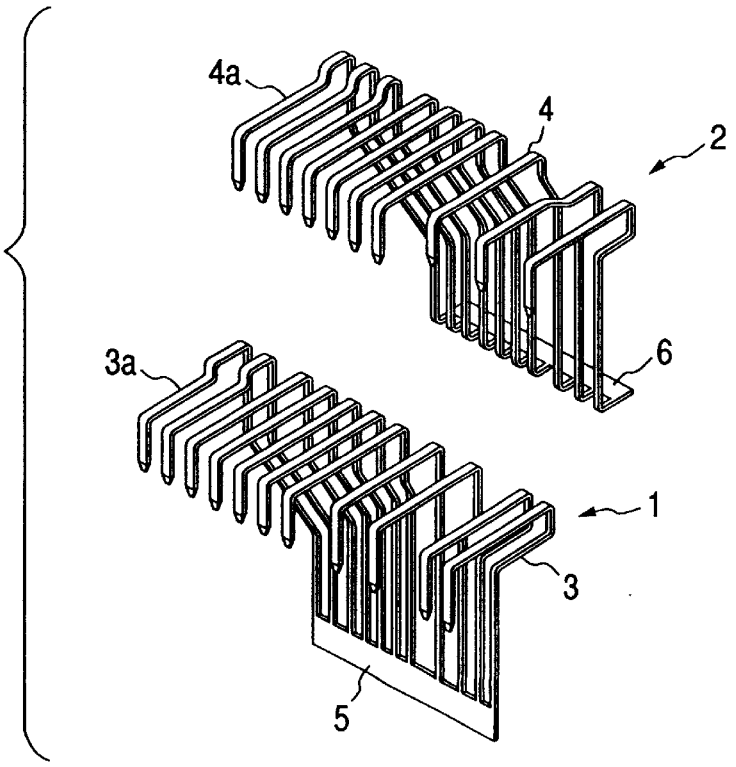
FIG. 3 PRIOR ART
FIG. 3 is a perspective view of conventional circuit members.

A detailed description will subsequently be given of the invention, wherein FIG. 1 shows circuit members embodying the invention; and FIGS. 2(*a*) to 2(*c*), a procedure for setting the circuit members in a mold.

As shown in FIG. 1, two circuit members 11 and 12 are employed according to this embodiment of the invention. The circuit member 11 has a plurality of bus bars 13 and the circuit member 12 also has a plurality of bus bars 14. These bus bars 13 and 14 in the circuit members 11 and 12 are respectively coupled together by means of coupling portions 15 and 16 so that the bus bars 13 and 14 are coupled in parallel to each other with a space provided therebetween. Moreover, each of the circuit members 11 and 12 is integrally formed by punching from a sheet material in such a way as to incorporate the bus bars 13 (14) and the coupling portion 15 (16).

Each of the bus bars 13 and 14 in the respective circuit members 11 and 12 includes a circuit forming portion 13*c* (14*c* ) which is bent a plurality of times along the direction of forming a circuit in order to form the internal circuit of an electrical component part, a leading end portion 13*a* (14*a* ) where a free end is formed, and a base portion 13*b* (14*b* )

where the aforementioned coupling portion 15 (16) is provided, these portions 13*c*, 13*a* and 13*b* being stretched in a row. Furthermore, the circuit forming portions 13*c* and 14*c* of the bus bars 13 and 14 are respectively plated with conductive materials 17 and 18 such as gold (see FIGS. 2(*a*) to 2(*c*)). The conductive plating materials 17 and 18 are applied to the respective circuit forming portions 13*c* and 14*c* so that the circuit forming portions 13*c* and 14*c* are connected by wire bonding to patterns on printed circuit boards.

The coupling portion 15 of one circuit member 11 out of the two circuit members 11 and 12 is flat, whereas the coupling portion 16 of the other circuit member 12 is formed with a bent portion 19. In this state illustrated, the bent portion 19 is formed by bending the base portion 14*b* where the coupling portion 16 is continuously provided whereby to bend the whole coupling portion 16. The bent portion 19 is, as shown in FIGS. 2(*a*) to 2(*c*), bent toward a mold (a bottom force 21), so that the bent portion 19 is used as a position regulating portion for temporarily setting, in the mold (the bottom force 21), the other circuit member 12 and the bus bars 13 of the one circuit member 11 with a space provided therebetween.

A description will subsequently be given of a procedure for setting the above circuit members 11 and 12 in the mold with reference to FIGS. 2(*a*) to 2(*c*). According to this embodiment of the invention, a relief portion 22 is formed in the bottom force 21, so that the bent coupling portion 16 of the other circuit member 12 is allowed to enter the relief portion 22.

Figure 2C:
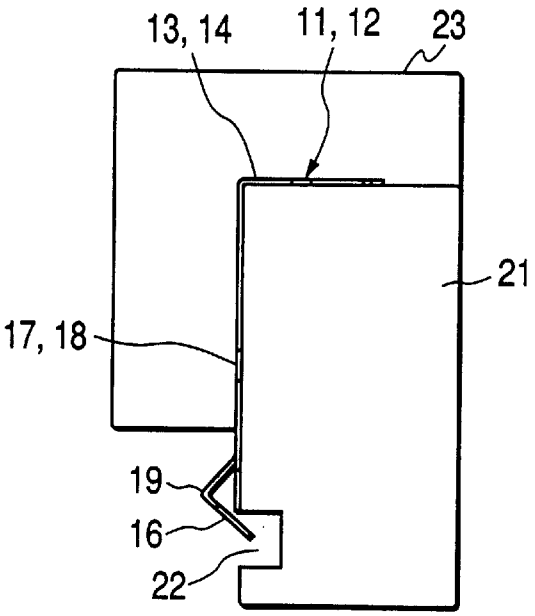
FIGS. 2(*a*) to 2(*c*) are side views illustrating a procedure for setting the circuit members in a mold.
Figure 2B:
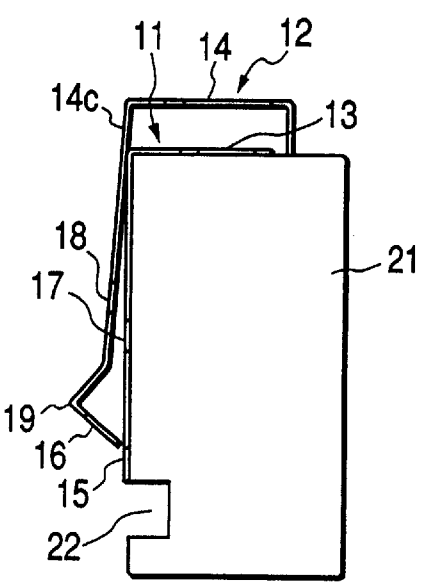
Figure 2A:
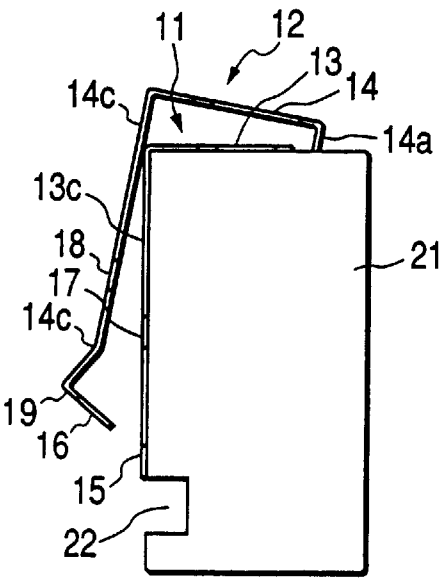
Figure 4A:
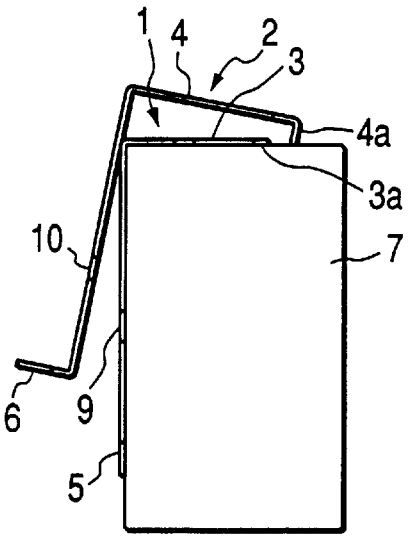
FIG. 4(a) PRIOR ART
FIGS. 4(*a*) to 4(*c*) are side views illustrating a procedure for setting the conventional circuit members in a mold.
Figure 4B:
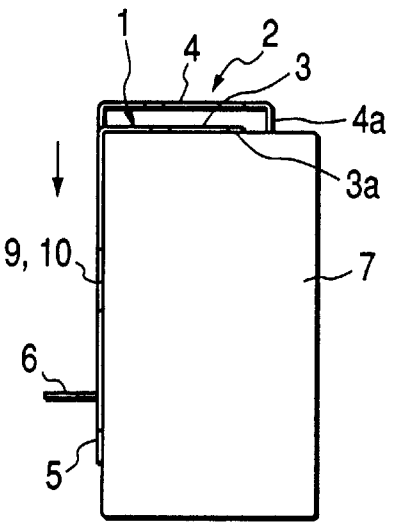
FIG. 4(b) PRIOR ART
Figure 4C:
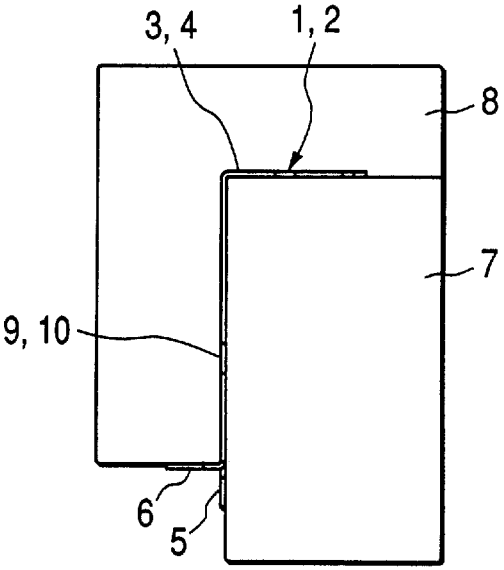
FIG. 4(c) PRIOR ART

As shown in FIG. 2(*a*) first, the free end 13*a* of the bus bar 13 in the one circuit member 11 is inserted and set in a positioning hole (not shown) of the bottom force 21. Then the free end 14*a* of the bus bar 14 in the other circuit member 12 is inserted into the positioning hole of the bottom force 21. At this time, the other circuit member 12 is tilted and kept slightly afloat with respect to the bottom force 21.

As shown in FIG. 2(*b*), the other circuit member 12 is subsequently put in a temporarily set and parallel condition with respect to the bottom force 21. In this temporarily set condition, the coupling portion 16 of the other circuit member 12 bent toward the bottom force 21 is brought into contact with the side of the bottom force 21. Consequently, the circuit forming portion 14*c* of the bus bar 14 of the other circuit member 12 is kept in such a condition that the circuit forming portion 14*c* thereof is spaced out from the bus bar 13 of the one circuit member 11. Thus, the conductive plated materials 18 and 19 of the bus bars 13 and 14 are prevented from being brought into contact with each other.

In this temporarily set condition, it is possible to confirm whether or not the bus bars 13 are out of contact with the bus bars 14. When both the bus bars may be brought into contact with each other, the positions of the bus bars 14 can be adjusted so as to fit the bus bars 14 in between the bus bars 13 without contact with the bus bars 13. Even during the time the positions are thus adjusted, the conductive plated materials 18 and 19 of the bus bars 13 and 14 are never brought into contact with each other since the space is provided between the other circuit member 12 and the one circuit member 11.

After the positions are thus confirmed and adjusted, a top force 23 is lowered as shown in FIG. 2(*c*). When the top force 23 is lowered, the other circuit member 12 is pressed downward and the bus bars 14 are fitted in between the bus bars 13 of the one circuit member 11 without contact with the bus bars 13, whereby a complete set of parallel circuit members 11 and 12 is obtained. In this completely set condition, the coupling portion 16 of the other circuit member 12 enters the relief portion 22 of the bottom force 21.

Clamping is carried out after the above setting is completed and resin is injected into the molds 21 and 23 after the clamping is carried out before being hardened for molding purposes. The bus bars 13 and 14 are thus resin molded. The bus bars 13 and 14 are fixed with the resin before being taken out of the molds. Then the base portions 13*b* and 14*b* of the respective bus bars 13 and 14 are cut off and the coupling portions 15 and 16 are also removed. Thus, a terminal structure with the bus bars 13 and 14 released from conduction is obtained.

Since the other circuit member 12 is provided with the bent portion 19 as a position regulating portion in this embodiment of the invention, the bus bars 13 and 14 can be kept out of contact with each other while the other circuit member 12 is completely set in the bottom force 21. Therefore, the conductive plated materials 17 and 18 of the respective bus bars 13 and 14 are prevented from rubbing against each other and also from peeling off or being damaged because of the friction. In consequence, it is ensured that reliable wire bonding is carried out with respect to the conductive plating.

Moreover, the position regulating portion can simply be provided since the bent portion 19 formed in the other circuit member 12 is used as such a position regulating portion for temporarily setting the member 12 in the bottom force 21.

As the bent portion 19 is provided in the coupling portion 16 which is removed afterward, the whole terminal structure remains unaffected by the presence of the bent portion 19 and this eliminates the trouble of altering the terminal design.

As set forth above, according to the invention, the bus bars of the two circuit members are prevented from being brought into contact with and rubbing against each other since the position regulating portion for setting the other circuit member apart from the bus bars of the one circuit member is provided in the other circuit member.

What is claimed is:

1. A terminal structure comprising:

a first circuit member;

a second circuit member, said first and second circuit members being formed with a plurality of bus bars respectively constituting internal circuits, the plurality of bus bars being coupled together in parallel by respective coupling portions with a space provided between the adjacent bus bars, the first and the second circuit members being successively set in a mold in such a way that the bus bars of the second circuit member are fitted in between the bus bars of the first circuit member without contacting the bus bars of the first circuit member the bus bars in that set condition being fixed by resin-molding; and a position regulating portion provided in the second circuit member for temporarily positioning the second circuit member such that the bus bars of the second circuit member are offset from the bus bars of the circuit member and from the mold.

2. The terminal structure according to claim 1, wherein the position regulating portion is a bent portion formed in the second circuit member in such a way as to bend toward the mold.

3. The terminal structure according to claim 2, wherein the bent portion is formed in the coupling portion of the second circuit member.

4. A terminal structure according to claim 1, wherein said mold comprises a recess.

5. A terminal structure according to claim 4, wherein said recess receives said position regulating portion.

* * * * *